United States Patent [19]

Eggers et al.

[11] 3,955,078

[45] May 4, 1976

[54] MULTI-PURPOSE FISHING LIGHT

[76] Inventors: Larry A. Eggers; Walter A. Eggers, both of 742 Westview St., Springfield, Mo. 65804

[22] Filed: Sept. 6, 1974

[21] Appl. No.: 503,774

[52] U.S. Cl. ..... 240/52 R; 240/3; 240/41 R

[51] Int. Cl.[2] ..... F21V 21/00

[58] Field of Search ..... 240/10.6, 26, 41 R, 240/3, 52 R, 6.4 R

[56] References Cited

UNITED STATES PATENTS

| | | | |
|---|---|---|---|
| 2,734,997 | 2/1956 | Frady | 240/52 R |
| 2,980,889 | 4/1961 | Meissner | 240/10.6 R |
| 3,254,206 | 5/1966 | Martelet | 240/41.35 R |
| 3,514,588 | 5/1970 | Roche | 240/26 X |
| 3,800,136 | 3/1974 | Edelson | 240/10.6 R |
| 3,838,267 | 9/1974 | Eggers et al. | 240/10.6 R |
| 3,851,166 | 11/1974 | Kohler | 240/41 R |

*Primary Examiner*—R. L. Moses

*Attorney, Agent, or Firm*—Lowe, Kokjer, Kircher, Wharton & Bowman

[57] ABSTRACT

A multi-purpose fishing light has a housing provided with an opening covered by a translucent lens. An aperture is formed in the lens for receiving the lens portion of a spot/flood lamp, while a fishing lamp assembly is mounted in the housing for reflecting light through the translucent lens. Control of the lamp is achieved by a regulator assembly including a rheostat and a four-position switch.

13 Claims, 4 Drawing Figures

MULTI-PURPOSE FISHING LIGHT

BACKGROUND OF THE INVENTION

1. Field of the Invention

This invention relates generally to an illuminating device, and more particularly to a multi-purpose fishing light incorporating fishing, spot, and flood light capabilities into a single light.

2. Description of the Prior Art

Our co-pending application Ser. No. 344,134, filed Mar. 23 1973, discloses a night fishing light especially suited for bass fishing, and the like. This night fishing light has a rheostat control providing adjustment of the brightness of a lamp forming the light to whatever natural light is available at a given time. More specifically, the brightness of the lamp is adjustable to whatever light is required for the fisherman to see the brush and bank edge, and the like, for night casting in order to catch bass and other fish.

Prior patents believed pertinent to the present invention are as follows:

| | | |
|---|---|---|
| 1,423,911 | A. D. Cardwell | July 25, 1922 |
| 1,444,831 | R. E. Dewey | Feb. 13, 1923 |
| 2,612,548 | E. F. Swanson | Sep. 30, 1952 |
| 2,656,452 | T. Phils | Oct. 20, 1953 |
| 2,744,187 | C. J. Moak | May 1, 1956 |
| 2,932,018 | J. J. Schwartz | Apr. 5, 1960 |
| 2,983,810 | R. S. James et al | May 9, 1961. |

SUMMARY OF THE INVENTION

It is an object of the present invention to provide a multi-purpose fishing light having fishing, spot, and flood lighting capabilities.

It is another object of the present invention to provide a multi-purpose fishing light small enough to fit into a larger size conventional fishing tackle box, yet simple in design, inexpensive to manufacture, rugged in construction, easy to use, moisture proof, and efficient in operation.

It is still another object of the present invention to provide a multi-purpose light which may be readily mounted on a boat, or the like, while being readily removable from the aforementioned mounting to be held in a user's hand.

These and other objects are achieved according to the present invention by providing a light having a housing having an opening; a lens arranged covering the openings of the housing; first and second lamps arranged in the housing; and a regulator system arranged for controlling the operation of the first and second lamps.

The lens is advantageously a translucent lens, and the first lamp an elongated lamp disposed in the housing for shining through the lens. The lens is preferably provided with an aperture, with the second lamp, which is advantageously a conventional spot/flood lamp, being disposed in the aperture in the lens.

According to a preferred embodiment of the present invention, the elongated lamp is part of an assembly including a block mounted on the wall of the housing opposite the opening of the housing and arranged facing the opening. A clip is mounted on the block for retaining the elongated lamp, while a concave reflector is aranged between the block and the housing wall for reflecting light emitted from the first lamp toward and through the lens.

The regulator system advantageously includes a rheostat and a four-position switch, with the rheostat and one position of the switch being connected in series with the elongated lamp. The spot/flood lamp is provided with two electrical contacts, one for spot mode and the other for flood mode, with respective other positions of the switch being connected to the two contacts of the spot/flood lamp.

A handle is preferably mounted on the wall on which the elongated lamp assembly is mounted, together with the rheostat and switch. In this manner, the control knobs for the rheostat and switch are available at the rear of the light for easy access and manipulation. The handle permits manual manipulation of the light. The lens is advantageously mounted on the housing over the opening thereof by screw fasteners engaged in sockets arranged at the corners of the housing. A cord terminating in a pair of conventional battery clips facilitates attachment of the light to a conventional battery, and the like, so that power is provided to the lamps.

A U-shaped bracket is advantageously provided to selectively mount the light on a support, such as a boat, and the like. This U-shaped bracket has a pair of substantially coplanar legs, each of which legs terminates in a V-shaped notch. The housing further includes coaxial trunions extending in opposite directions from the housing and arrangeable in the notches for selectively, and easily, mounting the light on a boat, and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
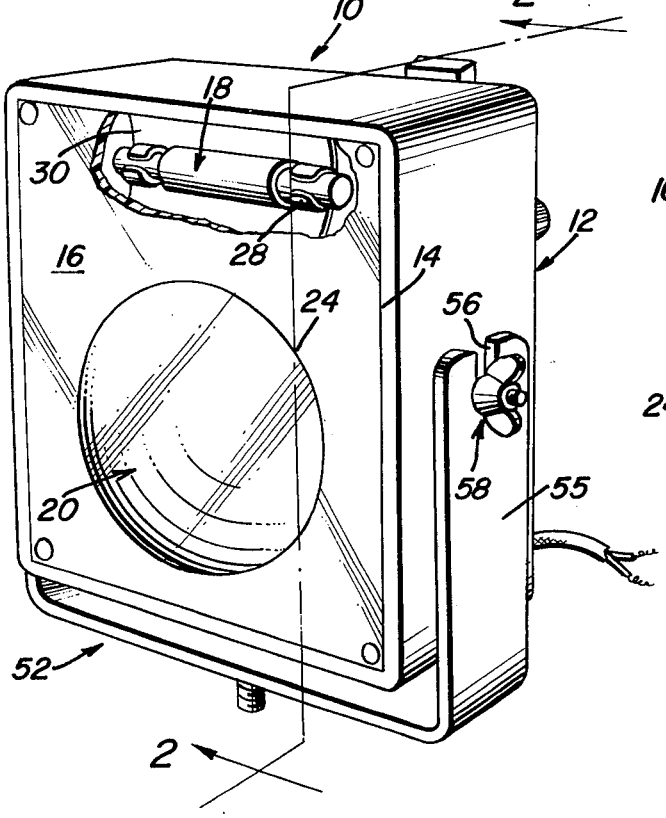
FIG. 1 is a fragmentary, perspective view, partly cut away and in section, showing a multi-purpose fishing light according to the present invention.
Figure 2:
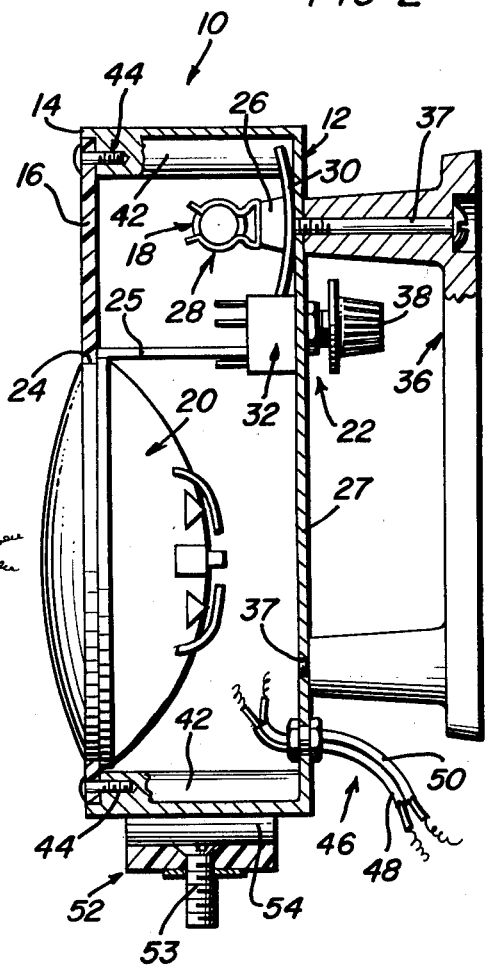
FIG. 2 is a fragmentary, sectional view taken generally along the line 2—2 of FIG. 1.
Figure 3:
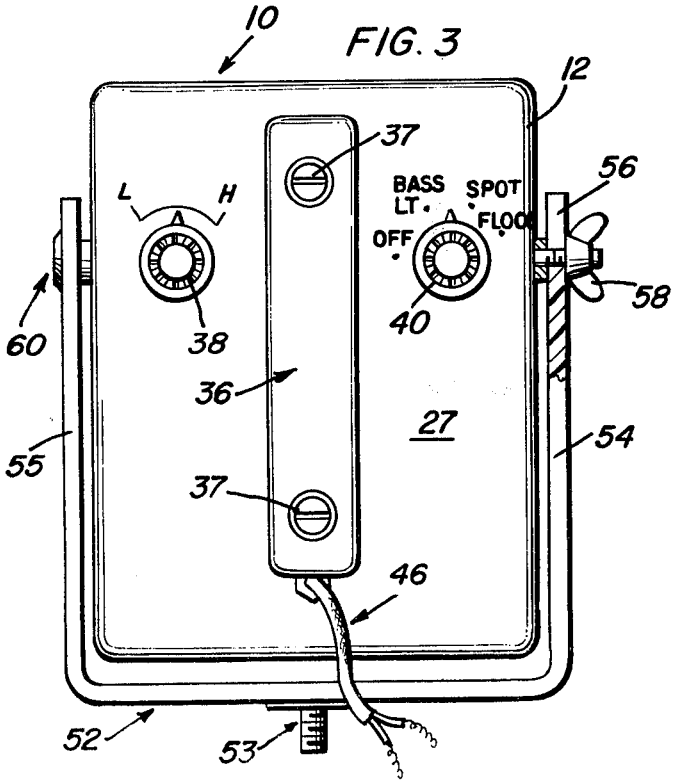
FIG. 3 is a fragmentary, rear elevational view, partly cut away and in section, showing the fishing light of FIGS. 1 and 2.

Referring now more particularly to FIGS. 1 through 3 of the drawings, a multi-purpose fishing light 10 according to the present invention has a housing 12 provided with an opening 14 across one face of the housing. A, for example, translucent lens 16 is arrangeable covering opening 14. Lens 16 may be constructed from, for example, a suitable synthetic, such as those formed from acrylic resins, while housing 12 is advantageously molded in one piece from a, for example, phenolic resin. A first lamp 18 which is advantagely an elongated lamp disposed in housing 12 for shining through lens 16, and a second lamp 20 which is advantageously a standard marine spot/flood sealbeam lamp, are arranged in housing 12. A regulator system 22 is provided for controlling the operation of lamps 18 and 20 in a manner to be described in detail below. Lens 16 is provided with a substantially circular aperture 24 of sufficient size to receive the lens portion of lamp 20. The latter is held in aperture 24 as is seen in FIG. 2 of the drawings by a retaining and spacing brace 25, which may be constructed from polyvinyl chloride, and the like. By engagement of the free end of cantilever mounted brace 25 which the periphery of lamp 20 when lens 16 is arranged on housing 12, lamp 20 is retained in its desired position. The ring about the lamp that separates the lens portion of the lamp from its associated reflector and lamp holding portion prevents lamp 20 from passing through aperture 24 and out of housing 12.

Lens 16, housing 12, and opening 14 are advantageously rectangular in configuration, with aperture 24 offset from a center of lens 16 and lamp 18 disposed in housing 12 in such a manner as to be offset relative to the same lens center in a direction away from aperture 24. In this manner, light rays from lamp 18 will be reflected through the largest unperforated portion of translucent lens 16.

Lamp 18 is advantageously part of an assembly including a rectangular block 26 mounted on a wall 27 of housing 12 opposite opening 14 and arranged facing opening 14. A clip 28 is mounted on block 26 in a conventional manner for retaining lamp 18 in easily removable fashion. Between block 26 and wall 27 is arranged a preferably concave reflector 30 which reflects light emitted from lamp 18 toward lens 16 in a concentrated and more efficient manner than would lamp 18 if such a reflector was not associated with the lamp.

The regulator system advantageously includes a rheostat 32 and a four-position switch 34 (FIG. 4), both of conventional construction. The manner in which rheostat 32 and switch 34 are connected to lamps 18 and 20 will be discussed in greater detail below with reference to FIG. 4 of the drawings.

Housing, wall 27 is desirably arranged substantially parallel to, and spaced from, lens 16. A handle 36 which may also be molded from a phenolic resin similar to that used for constructing housing 12, is mounted on wall 27 at the side thereof which permits the handle to extend away from lens 16 and housing 12. Handle 36 may be mounted on wall 27 as by the bolts 37 shown in FIGS. 2 and 3 of the drawings. It is to be understood that the uppermost bolt 37 shown in FIG. 2 of the drawings may be slightly longer than the lower bolt 37 in order to employ the bolt to retain block 26, reflector 30 and even clip 28 on wall 27. Rheostat 32 and switch 34 are mounted on wall 37 such that their control shafts extend outwardly of housing 12, and knobs 38 and 40 are advantageously mounted on the aforementioned control shafts facilitating actuation of the switch and rheostat. A plurality of threaded sockets 42 are arranged in the corners of rectangular housing 12, and lens 16 is secured to housing 12 by screw fasteners 44 engaged in sockets 42. As will be readily appreciated from FIG. 2, the sockets 42 form an abutment which properly positions lens 16 with respect to housing 12.

A cord 46 is provided for connecting the switch, rheostat, and lamps to a suitable source of electric power, such as a conventional marine battery (not shown) and the like. This cord 46, which passes out of housing 12 through a grommeted aperture, as is conventional, has a pair of wires 48 and 50, each of which my be provided with, for example, copper plated battery clips (not shown) which facilitate engagement of the wires to a battery external of the light so as to provide the lamps with a source of power.

Light 10 is advantageously used in conjunction with a substantially U-shaped racket 52 mountable on a support (not shown) such as the rail of a boat, by the screw 53 arranged in aperture formed in the bight portion of bracket 52. The latter is also provided with a pair of substantially coplanar legs 54, each of which terminates in a V-shaped notch 56. Housing 12 further includes coaxial trunions 58 and 60 extending in opposite directions from housing 12 and arrangeable in notches 56 in the manner shown in FIGS. 1 and 3 of the drawings. It will be appreciated that the arrangement of lamp 20 in the lower portion of housing 12 will cause the light 10 to be bottom heavy and therefore remain substantially vertical in notches 56 as the boat (not shown), and the like, with which light 10 is being used rocks in the direction perpendicular to the axis formed by trunions 58. When desired, however, light 10 may be quickly and easily removed from bracket 52 simply by grasping the light by its handle 36 and lifting the light from the bracket.

Figure 4:
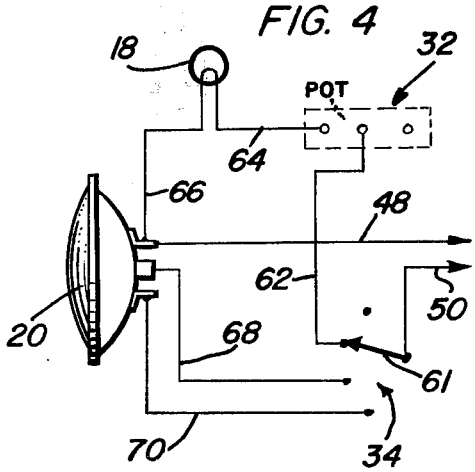
FIG. 4 is a schematic diagram showing an electrical circuit for a fishing light according to the present invention.

Referring now to FIG. 4 of the drawings, wire 48 of cord 46 is connected to one side of a battery (not shown), and the like, and to the common pole of lamp 20, while wire 50 of cord 46 is also connected to the battery and to the wiper contact 61 of switch 34. As can be readily appreciated from FIG. 4, one contact position of switch 34 is connected rheostat 32 as by line 62. The rheostat is itself connected to one side of lamp 18 by a line 64, while the other side of lamp 18 is connected to wire 48 by a line 66. Thus, rheostat 32 and lamp 18 are connected in series with one position of switch 34, and when wiper contact 61 is in the position illustrated in FIG. 4 of the drawings, a circuit will be completed through lamp 18. Lamp 20 has two contacts other than the common contact referred to above. One of these two contacts forms a connection for a spot mode of the lamp 20, while the other of the two contacts forms a connection for a flood mode of lamp 20. These two contacts are connected to two other positions of switch 34 by wires 68 and 70 as shown in FIG. 4. Accordingly, when wiper contact 51 is moved into contact with each of the positions of switch 34 associated with wires 68 and 70, a circuit will be completed through lamp 20 to form the spot mode and flood mode, respectively. In this manner, light 10 can be used to function in any one of three different manners; as a night fishing light, a spot light, and a flood light.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multi-purpose fishing light comprising, in combination:

a. a box-like housing having a rectangular opening therein;

b. a rectangular, translucent lens covering the opening of the housing, the lens having an aperture offset from the center of the lens;

c. an elongate first lamp for shining light through the lens disposed in the housing offset from the center of the lens in a direction away from the aperture;

d. a second lamp disposed in the aperture in the lens; and e. regulator means for controlling the operation of the first and second lamps.

2. A structure as defined in claim 1, further including a rectangular block mounted on a wall of the housing disposed opposite the opening of the housing and arranged facing the opening, a clip mounted on the block for retaining the first lamp, and a concave reflector arranged between the block and housing wall for reflecting light emitted from the first lamp toward the lens.

3. A structure as defined in claim 2, wherein the regulator means includes a rheostat and a four-positioned switch, the rheostat and one position of the switch being connected in series with the first lamp, and the second lamp having two connections, one for spot mode and one for flood mode, with respective other positions of the switch being connected to the two connections of the second lamp.

4. A structure as defined in claim 3, wherein the housing wall is arranged substantially parallel to and spaced from the lens, a handle mounted on the wall and extending away from the lens and housing, rheostat and switch mounted on the wall and having actuating shafts extending through the wall and away from the housing, a pair of control knobs mounted on the control shafts for actuating the switch and rheostat, a plurality of threaded sockets arranged in corners of the rectangular housing, the lens being secured on the housing by screw fasteners engaged in the sockets, and cord means for connecting the switch and lamps to a source of power for lighting the lamps.

5. A structure as defined in claim 4, in combination with a substantially U-shaped bracket mountable on a support, the bracket having a pair of substantially coplanar legs each terminating in a V-shaped notch, and the housing further including coaxial trunions extending in opposite directions from the housing and arrangeable in the notches.

6. A structure as defined in claim 1, further including a rectangular block mount on a wall of the housing disposed opposite the opening of the housing and arranged facing the opening, a clip mounted on the block for retaining the first lamp, and a concave reflector arranged between the block and housing wall for reflecting light emitter from the first lamp toward the lens.

7. The fishing light as in claim 1 in combination with a base bracket to support the fishing light, the fishing light having a centerline intermediate the height thereof and a center of gravity below the centerline, the housing including trunnions at opposite sides thereof and above the centerline to support the fishing light on the bracket.

8. A structure as defined in claim 1, in combination with a substantially U-shaped bracket mountable on a support, the bracket having a pair of substantially coplanar legs each terminating in a V-shaped notch, and the housing further including coaxial trunions extending in opposite directions from the housing and arrangeable in the notches.

9. A multi-purpose fishing light comprising, in combination:

a. a box-like housing having a rectangular opening therein;

b. a rectangular lens covering the opening of the housing, the lens having an aperture offset from the center of the lens;

c. a first lamp disposed in the housing offset from the center of the lens in a direction away from the aperture;

d. a second lamp disposed in the aperture of the lens; and e. regulator means for controlling operation of the first and second lamps.

10. A multi-purpose fishing light comprising, in combination:

a. a housing having an opening;

b. a lens arranged covering the opening of the housing;

c. first and second lamps arranged in the housing; and d. regulator means for controlling the operation of the first and second lamps, the regulator means including a rheostat and a four-position switch, the rheostat and one position of the switch being connected with the first lamp, and the second lamp having two connections, one for spot mode and one for flood mode, with respective other positions of the switch being connected to the two connections of the second lamp.

11. A multi-purpose fishing light comprising, in combination:

a. a housing having an opening, a substantially rectangular back wall arranged substantially parallel to and spaced from the plane of the opening, and a plurality of threaded sockets arranged in the corners of the housing;

b. a lens covering the opening and secured to the housing by screw fasteners engaged in the sockets;

c. a handle mounted on the back wall of the housing and extending away from the lens and housing;

d. first and second lamps arranged in the housing; and e. regulator means for controlling the operation of the first and second lamps.

12. A multi-purpose fishing light having intermediate the height thereof and a center of gravity located below the centerline thereof, said fishing light comprising, in combination:

a. A box-like housing having an opening therein;

b. a first lamp for emitting a soft glowing light of adjustably variable intensity mounted in the housing above the centerline thereof;

c. adjustment means connected to the first lamp to adjustably vary the intensity of light from the first lamp;

d. a translucent lens connected to the housing remote from the first lamp to transmit therethrough the light emitted from the first lamp;

e. a second lamp for selectively emitting a bright spotlight or a bright floodlight mounted to the housing with the major portion of the second lamp positioned below the centerline of the housing; and f. switch means for controlling the operation of the first and second lamps.

13. The fishing light as in claim 12 in combination with a base bracket to support the fishing light, and in which the housing includes trunnions at opposite sides thereof and above the centerline of the housing to support the fishing light on the bracket.

* * * * *